US006698753B2

(12) United States Patent
Chujo et al.

(10) Patent No.: US 6,698,753 B2
(45) Date of Patent: Mar. 2, 2004

(54) DEVICE FOR AND METHOD OF DETECTING AN OVERLAP IN PAPER BEING TRANSPORTED

(75) Inventors: Hideki Chujo, Mukou (JP); Tomohiro Inoue, Kusatsu (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 10/292,381

(22) Filed: Nov. 7, 2002

(65) Prior Publication Data

US 2003/0094748 A1 May 22, 2003

(30) Foreign Application Priority Data

Nov. 22, 2001 (JP) ..... 2001-358261

(51) Int. Cl.[7] ..... B65H 7/12

(52) U.S. Cl. ..... 271/262; 73/1.81; 101/73; 324/229

(58) Field of Search ..... 271/4.03, 10.03, 271/262; 73/1.81; 324/229, 635, 644, 662, 671, 691, 716; 101/73

(56) References Cited

U.S. PATENT DOCUMENTS 4,066,969 A * 1/1978 Pearce et al. ..... 367/125
5,348,286 A * 9/1994 Buck ..... 271/263
6,281,679 B1 * 8/2001 King et al. ..... 324/229
6,397,671 B1 * 6/2002 Nishio et al. ..... 73/159
2001/0042956 A1 * 11/2001 Minoru et al. ..... 271/265.04

* cited by examiner

*Primary Examiner*—Donald P. Walsh
*Assistant Examiner*—Kenneth W Bower
(74) *Attorney, Agent, or Firm*—Beyer Weaver & Thomas LLP

(57) ABSTRACT

An unintentionally overlapped condition in a paper sheet being transported is detected by making ultrasonic waves incident on its path and detecting a phase difference between the received ultrasonic waves and a predetermined standard phase. For detecting an overlap on the basis of this phase difference, a specified data item on the detected overlap such as a cumulative number of times an overlap has been detected is generated and one of a plurality of preliminarily defined levels corresponding to this specified data item is selected. The selected level is outputted. If the overlap is detected over an entire detection range of the paper sheet from its front edge to the back edge, however, it is concluded that there is no possibility of an unintentional overlap.

5 Claims, 12 Drawing Sheets

DEVICE FOR AND METHOD OF DETECTING AN OVERLAP IN PAPER BEING TRANSPORTED

BACKGROUND OF THE INVENTION

This invention relates to a device for and a method of detecting an overlap in paper being transported. More particularly, this invention relates to such a device and a method capable of dependably informing the user whether or not the detected overlap is of a kind to be avoided or a kind that may be ignored.

When a plurality of sheets of paper to be scanned individually are simultaneously transported in an overlapped condition even partially, it is not possible to carry out an accurate scan. For this reason, many scanners of this type are provided with an overlap detector, or a detector for detecting an overlapped condition of paper sheets being transported such that the transportation of the paper sheets may be stopped temporarily. In other words, scanning by such a scanner is interrupted when the overlap detector detects an overlapped condition.

The scanning operation of a scanner is interrupted also when the overlap detector detects an overlapped condition erroneously, forcing the user to go through the troublesome process of investigating the cause of the interruption and restarting the scanning. Another problem with such a prior art overlap detector is that it always concludes that there is an overlap of the kind for which the transportation of paper should be interrupted whenever two sheets of paper are found to be overlapping. In other words, doubly folded sheets and two sheets of intentionally overlapped paper are both treated as representing an overlapped condition for which the transportation of the paper should be interrupted.

SUMMARY OF THE INVENTION

It is therefore an object of this invention to provide a device for and a method of accurately detecting an overlap in paper being transported such that doubly folded paper and two sheets of paper that are intentionally overlapped may be distinguished.

An overlap detecting device according to this invention may be characterized as comprising a detecting means for detecting an overlapped condition in a paper sheet being transported on its transportation path, a data generating device for generating a specified data item on the overlap detected by the detecting means, a level selector for selecting one of a plurality of preliminarily defined levels corresponding to the specified data item generated by the data generating device, and an output device for outputting the selected level by the level selector. Thus, as an overlapped condition of a paper sheet being transported on a path is detected, a specified data item about the overlap is generated, its level is selected from a plurality of preliminarily defined levels and the selected level is outputted to be referenced by the user. The user can thereby determine whether the overlap was of an intentional or unintentional kind. The data generating device and the level selector may each comprise a CPU.

For the detection of the overlap, use may be made of an ultrasonic wave generator for generating ultrasonic waves to be made incident on the path of transportation of the paper sheet, an ultrasonic receiver for receiving the ultrasonic waves generated by the ultrasonic wave generator and a phase difference detector which may comprise a CPU for detecting a phase difference between the ultrasonic waves received by the ultrasonic wave receiver and a predetermined standard phase. An overlap in a paper sheet being transported on the path can be detected from the phase difference detected by the phase difference detector.

The aforementioned data item serves to indicate a possibility of occurrence of the overlap, and the preliminarily defined levels include a first level indicating that the overlap is certainly taking place and a second level indicating that there is a possibility that the overlap is taking place. Thus, if the first level is outputted during a scanning operation, the scanning is interrupted but the scanning can be continued if the output is the second level. In this manner, interruption of the scanning due to an erroneous detection of an overlap can be restrained.

The aforementioned data item may include a cumulative number of times the overlap has been detected by the overlap detector and the level selector may include a first level selector and a second level selector, the first level selector selecting the first level if the cumulative number is equal to or greater than a predefined first threshold value, the second level selector selecting the second level if the cumulative number is equal to or greater than a predefined second threshold value which is smaller than the first threshold value. The first and second level selectors may each comprise a CPU. In this manner, the level of possibility for the occurrence of an overlap can be dependably determined, and these levels can be freely adjusted by the user or by the maker by merely changing the values of the first and second threshold values.

The aforementioned data generating device may reset the cumulative number of times to zero if the paper sheet is on its path of transportation but the overlap has not been detected by the overlap detector. In this manner, the levels for determining the possibility of an overlap can be set more reliably.

There may also be provided a judging device for judging that there is no possibility that an unintentional overlap has occurred if the overlap is detected by the overlap detector over an entire detection range of the paper sheet from its front edge to its back edge. In other words, a doubly folded paper sheet or two intentionally overlapped sheets of paper are not considered to be an unwanted overlap. Thus, a scanner provided with a detecting device of this invention can operate on doubly folded paper sheets and pairs of intentionally overlapped paper sheets. Such a judging device may comprise a CPU which may not be the same as any of the CPUs referred to above but may comprise a CPU of a multi-purpose personal computer.

An overlap detection method of this invention may be characterized as comprising the steps of generating ultrasonic waves to be made incident on the path of transportation of the paper sheet, receiving the ultrasonic waves made incident on the path, detecting a phase difference between the received ultrasonic waves and a predetermined standard phase, detecting an overlap in a paper sheet being transported on the path on the basis of the detected phase difference, generating a specified data item on the detected overlap, selecting one of a plurality of preliminarily defined levels corresponding to the specified data item, outputting the selected level, and judging that there is no possibility of an unintentional overlap if the overlap is detected over an entire detection range of the paper sheet from its front edge to its back edge. When an overlap is detected by a method of this invention, a specified data item is generated on the detected overlap, a level for the specified data item is selected from a plurality of preliminarily defined levels and the selected level is outputted. Thus, the user can easily judge whether or not the detected overlap is an unwanted overlap.

DETAILED DESCRIPTION OF THE INVENTION

Figure 1:
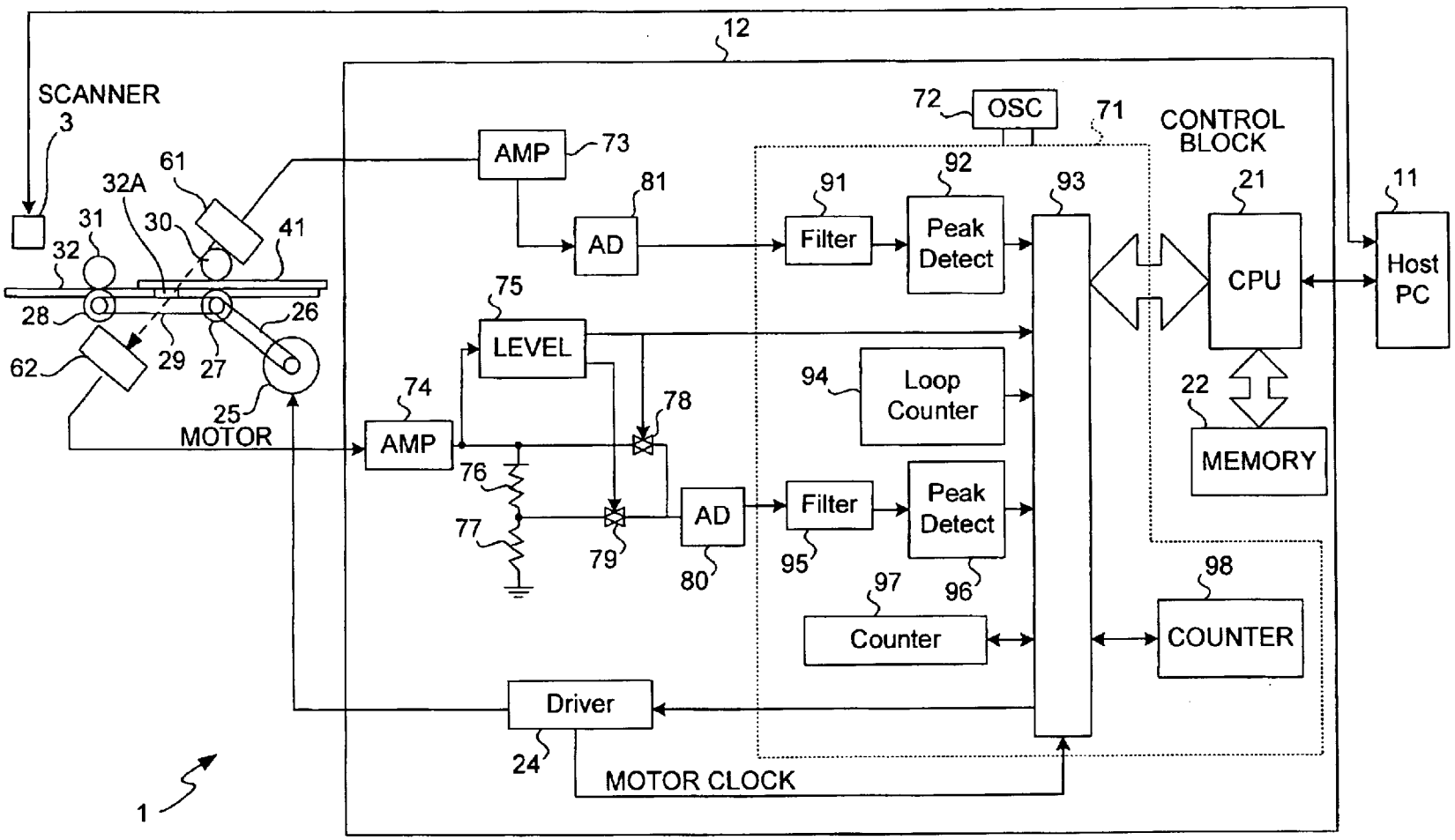
FIG. 1 is a block diagram of a device for detecting an overlap embodying this invention.

FIG. 1 shows the structure of an overlap detector 1 embodying this invention, comprising a host personal computer (PC) 11 for setting various parameters and thereby controlling an overlap detection unit 12. The overlap detection unit 12 includes a CPU 21 which serves to control the operations of each component of the overlap detection unit 12 through a processing unit 93 on the basis of various signals received from the host PC 11. The CPU 21 also controls the overall operations of the overlap detection unit 12 through the processing unit 93 according to a program stored in a memory device 22. The memory device 22 additionally stores various data necessary for the CPU 21 in carrying out various operations. The CPU 21 also serves to transmit to the host PC 11 various data stored in the memory device 22 as well as signals supplied from the processing unit 93 (such as a paper detection signal 142, a "possibility message signal" 142 and an "overlap message signal" 143 to be explained below), whenever necessary.

The overlap detection unit 12 has a motor driver 24 for driving and thereby causing a motor 25 to rotate. The rotary motion of the motor 25 is communicated to a roller 27 through a belt 26, and the rotary motion of the roller 27 is further communicated to another roller 28 through another belt 29. Rollers 30 and 31 are pressed respectively against the rollers 27 and 28 such that a sheet of paper 41 clamped between the rollers 27 and 30 is transported on a paper feeding plate 32 from the right to the left with reference to the figure, and clamped between the rollers 28 and 31 to be transported further to the left.

The image on the paper sheet 41 thus transported on the paper feeding plate 32 is scanned by a scanner 3 on the basis of a control by the host PC 11. The scanned image data are supplied from-the scanner 3 to the host PC 11.

Numeral 61 indicates an ultrasonic transmitter controlled by an oscillation amplifier 73 to transmit ultrasonic waves onto the transportation path of the paper sheet 41. Ultrasonic waves transmitted from the transmitter 61 and passing through the paper sheet 41 as well as waves passing through a hole 32A formed through the paper feeding plate 32 are received by an ultrasonic receiver 62. The receiver 62 also serves to output a reception signal to an amplifier 74.

A clock signal generated by an oscillator 72 is supplied to a control block 72 which carries out various processes in synchronism with this clock signal such as controlling the oscillation amplifier 73 such that the ultrasonic transmitter 61 is driven thereby and will generate ultrasonic waves.

The output from the oscillation amplifier 73 is transmitted to a filter 91 of the control block 71 through an AD converter 81 for monitoring. The filter 91 serves to eliminate the high-frequency noise components from the inputted signal and to output the signal to a peak detector unit 92. The peak detector unit 92 serves to detect a peak value from the inputted signal and outputs the detected peak value to the processing unit 93.

The amplifier 74 amplifies the output from the receiver 62 and transmits the amplified output to a level judging unit 75 for evaluating the level of the signal inputted from the amplifier 74. If this level is above a threshold value, it is judged that there is no paper sheet 41. If this level is below the threshold value, it is judged that the paper sheet 41 is present. If it is judged that the paper sheet 41 is present, a detection signal (the "paper detection signal") is outputted to the processing unit 93. The paper detection signal is also supplied to the host PC 11 through the CPU 21. At the same time, analog switches 78 and 79 are respectively switched on and off by the level judging unit 75 and the output from the amplifier 74 is inputted to an AD converter 80.

If it is judged that the paper sheet 41 is absent, on the other hand, the analog switches 78 and 79 are respectively switched off and on by the level judging unit 75 and the output from the amplifier 74 is divided (and hence attenuated) by means of resistors 76 and 77 and then inputted to the AD converter 80.

The high frequency noise components of the signal inputted from the AD converter 80 are eliminated by a filter 95 and the filtered signal is outputted to a peak detector unit 96 for detecting a peak value of the signal inputted from the filter 95 and outputting it to the processing unit 93.

Clock signals supplied from the oscillator 72 are counted by a loop counter 94 and the counted values are outputted to the processing unit 93. The number of times the phase difference of the received signal has exceeded a threshold value (AZ) (hereinafter referred to as the "overlap frequency J" where J is an integer) is counted by a judgement counter 97. The number of sampling is counted by a data number counter 98.

If the frequency of the signal outputted to the ultrasonic wave transmitter 61 from the amplifier 73 is f, the frequency of the clock signals outputted from the oscillator 72 may be set equal to 360*f*. The AD converters 80 and 81 carry out sampling operations at this frequency (360*f*) and the loop counter 94 counts the clock signals also at this frequency (360*f*).

Figure 2:
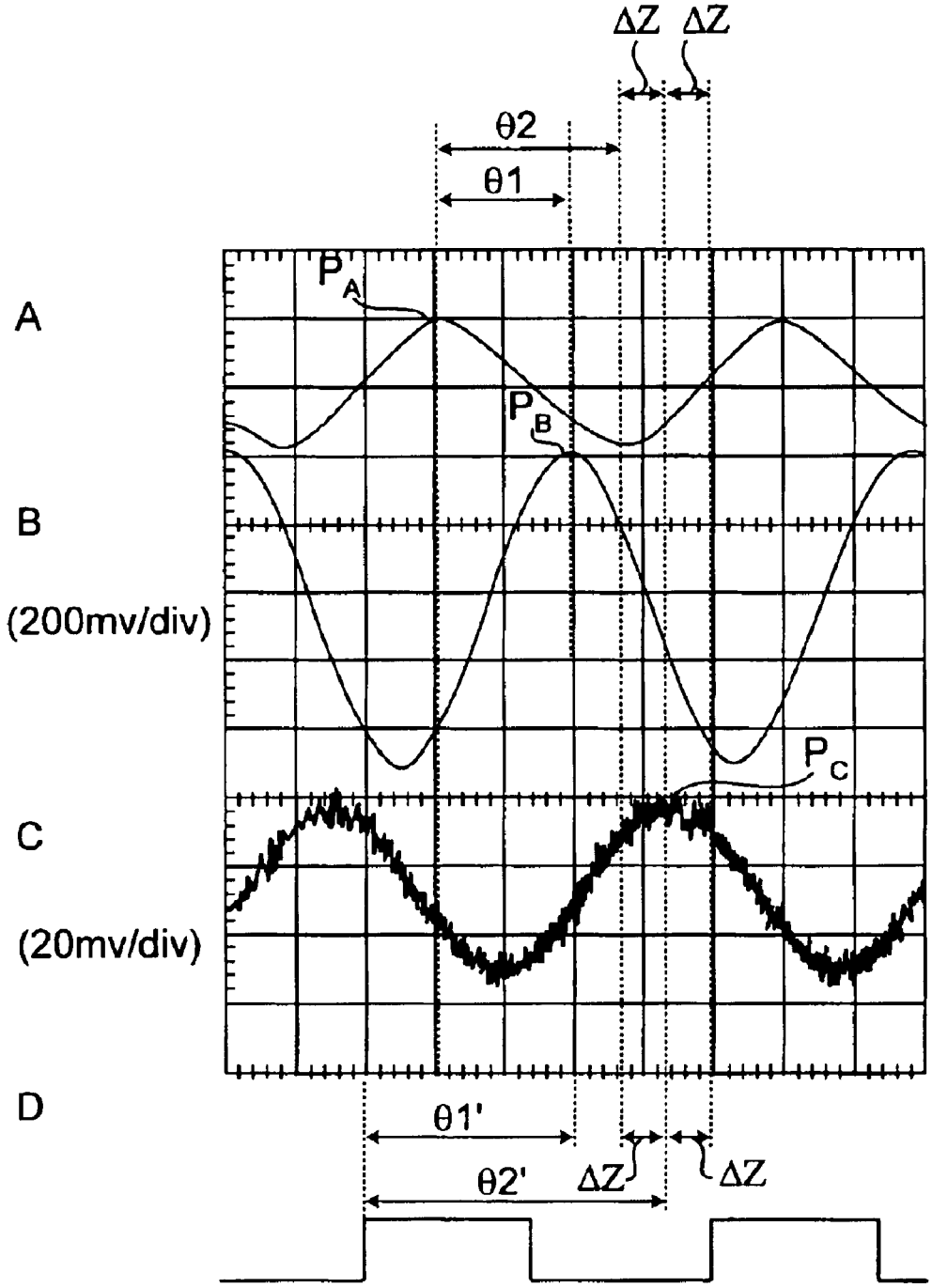
FIG. 2 is a graph for showing the principle of detecting an overlap by the phase of ultrasonic waves.

FIG. 2 is referenced next to explain the principle of detecting an "overlap phase" on the basis of the phase of the received signal of ultrasonic waves.

FIG. 2A shows the level and the phase of the ultrasonic waves transmitted from the transmitter 61 (or the signal for controlling the transmitter 61 by the amplifier 73). When the transmitter 61 transmits an ultrasonic wave with such a phase on the basis of a control signal from the amplifier 73, the receiver 62, upon receiving the wave, outputs a reception signal as shown in FIG. 2B or 2C to the amplifier 74.

FIG. 2B shows the level and the phase of the reception signal when the paper sheet 41 is not present on the path of its transportation (on the propagation path of the ultrasonic waves), and FIG. 2C shows those when the paper sheet 41 is present. They clearly show that the signal level is higher when the paper sheet 41 is absent (FIG. 2B) than when the paper sheet 41 is present (FIG. 2C). It is reminded that the signal level is shown in units of 200 mV/div in FIGS. 2A and 2B but in units of 20 mV/div in FIG. 2C.

When the paper sheet 41 is not present, the phase lag of the received signal with respect to the transmitted signal is θ1, that is, the phase difference between the peak $P_A$ of the transmitted signal shown in FIG. 2A and the peak $P_B$ of the received signal shown in FIG. 2B is θ1. When a single sheet of paper 41 is present, by contrast, the phase lag of the received signal (FIG. 2C) with respect to the transmitted signal (FIG. 2A) becomes θ2, that is, the phase difference between the peak $P_C$ of the received wave shown in FIG. 2C and the peak $P_A$ of the transmitted wave shown in FIG. 2A becomes θ2.

These phase differences θ1 and θ2 have different values. Variations in the phase difference θ2 when a single sheet of paper 41 is present are relatively small, being within the range of ±ΔZ with respect to the phase difference θ2.

When there is an overlap, however, the phase difference θ in such a situation is not within the range of θ2±ΔZ but falls outside of this range. This makes it possible to determine whether or not there is an overlap by examining whether or not the phase difference of the received signal is within a standard range (θ2±ΔZ).

In what follows, the phase difference θ of the reception signal will be referred to as the "reception phase difference" and the phase difference determined not to be within the range of θ2±ΔZ, that is, the phase difference determined to be indicating an overlap will be referred to as the "overlap phase difference."

Since the determination whether a phase difference is an overlap phase difference or not is to be made by using a relative change in the phase of the received wave, the starting point for the measurement of the phase of the received wave need not be selected as in the illustrated example. If the received wave is of a standard waveform with the same frequency as the transmitted wave, any point may be selected if the relative phase difference of the received wave can be obtained. For example, a standard (reference) waveform such as shown in FIG. 2D having the same frequency as the transmitted wave shown in FIG. 2A and the relative phase θ2' of the received wave (FIG. 2C) may be determined from its rising edge serving as the base point. In such a case, the phase θ1' at the time of no paper sheet is also measured from the same base point, that is, the rising edge of the reference waveform. In the example, the determination on an overlap phase difference is made on this principle.

Figure 3:
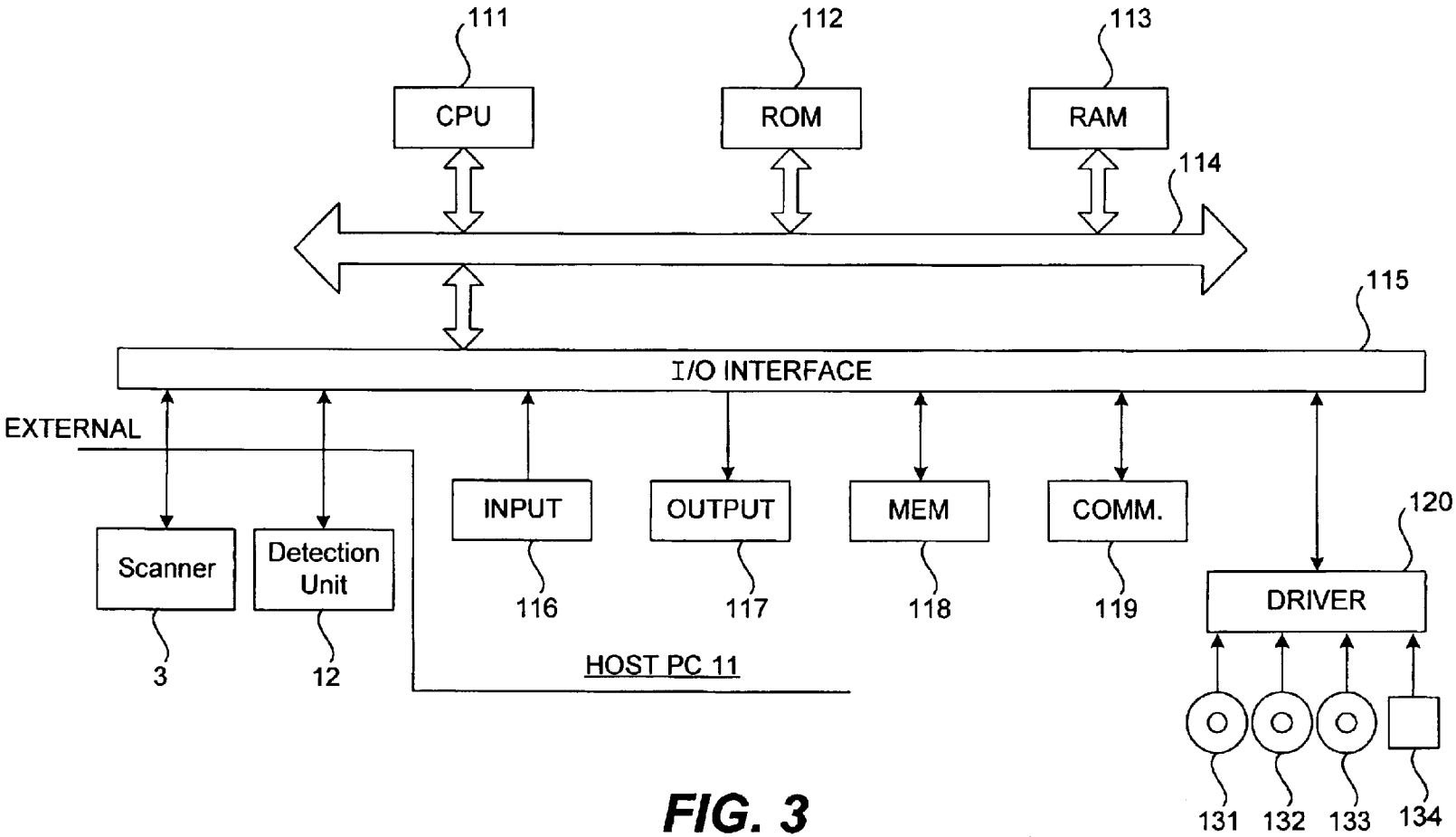
FIG. 3 is a block diagram of a host PC of the overlap detecting device of FIG. 1.

FIG. 3 shows an example of the structure of the host PC 11. Numeral 111 therein indicates a CPU adapted to carry out various operations according to programs stored in an ROM 112 or programs loaded from a memory device 118 to a RAM 113. Various data necessary for the CPU 111 in carrying out its various operations are also conveniently stored in the RAM 113.

The CPU 111, the ROM 112 and the RAM 113 are mutually connected through a bus 114, to which an I/O interface 115 is also connected. An input device 116 comprising a keyboard and a mouse, an output device 117 comprising a CRT display, the memory device 118 comprising a hard disk, and a communication device 119 comprising a modem and terminal adapters are connected to the I/O interface 115. The communication device 119 carries out network communications inclusive of internet communications.

If necessary, a driver 120 may be connected to the I/O interface 115 such that a magnetic disk 131, an optical disk 132, a photo-electromagnetic disk 133, or a semiconductor memory 134 may be attached and a computer program read out from them may be installed in the memory device 118.

When a series of operations are executed by software, a program comprising this software is installed from a network or a memory medium onto a computer installed in dedicated hardware or a multi-purpose personal computer having various programs installed so as to be able to carry out various functions.

The memory medium may comprise, as shown in FIG. 3, a magnetic disk 131 (inclusive of a floppy disk), an optical disk 132 (inclusive of a CD ROM and a DVD), an photo-electromagnetic disk 133 (inclusive of mini-Disks) and packaged media including a semiconductor memory 134 which stores programs and may be distributed to the user for supplying programs, apart from the apparatus itself. It may also include the ROM 112 and a hard disk included in the memory device 118 storing programs which are supplied to the user in the form of already being installed in the apparatus.

The aforementioned scanner 3 and the overlap detection unit 12 are also connected to the I/O interface 115.

Thus, a memory medium storing programs to be executed by the overlap detection unit 12 may be connected to the driver 120 such that the programs read therefrom may be supplied to the overlap detection unit 12 through the I/O interface, whenever necessary, and further installed in the memory device 22 through the CPU 21 inside the overlap detection unit 12.

Figure 4:
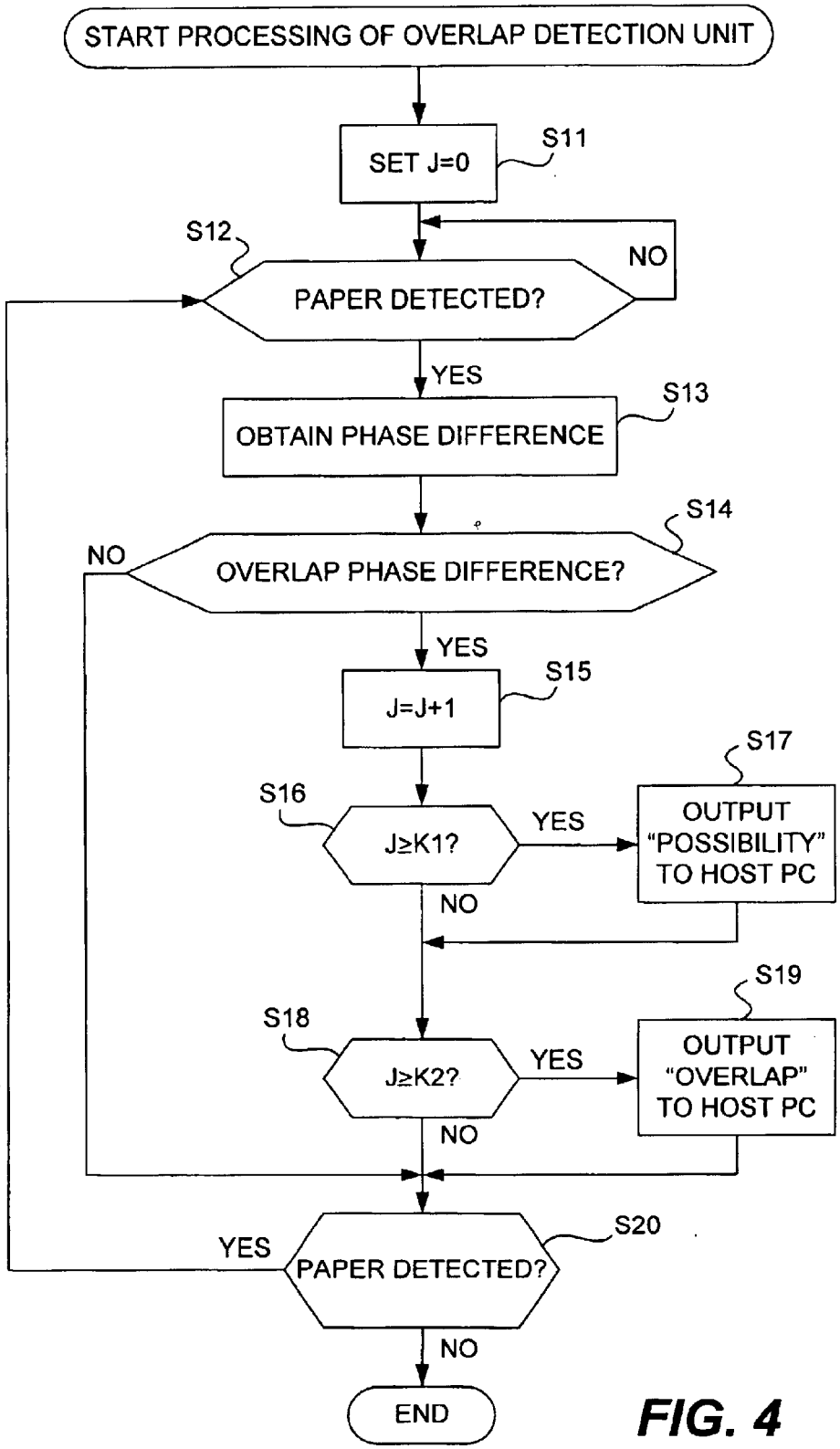
FIG. 4 is a flowchart for the processing by the overlap detection unit of the device of FIG. 1.

The flowchart of FIG. 4 is referenced next to explain an example of processes carried out by the overlap detection unit 12. First, the CPU 21 resets the overlap frequency J of the judgment counter 97 equal to zero through the processing unit 93 (Step S11). Next, the CPU 21 checks whether or not the paper sheet 41 has been detected (Step S12). Explained more in detail, if the paper detection signal has been supplied from the level judging unit 75 through the processing unit 93, the CPU 21 concludes that the paper sheet 41 has been received by inputting and recognizing this signal. If otherwise (that is, if no detection signal is supplied), it concludes that the paper sheet 41 has not been detected.

If it is determined that the paper sheet 41 has not been detected (NO in Step S12), the CPU 21 waits until it is detected. When the paper sheet 41 is detected (YES in Step S12), the reception phase difference is obtained (Step S13) and the paper detection signal, which has been supplied from the level judging unit 75 through the processing unit 93, is transmitted to the host PC 11. Next, the CPU 21 determines whether the reception phase difference is an overlap phase difference (Step S14). Details of Steps 13 and 14 are the same as already explained above with reference to FIG. 2.

If it is determined not to be an overlap phase difference (NO in Step S14), the CPU 21 checks whether or not the paper sheet 41 has been detected (Step S20). This is similar to Step S12 but is different in that Step S132 is for determining whether or not the paper sheet 41 has been brought onto its transportation path, or whether or not its transportation has been started, while Step S20 is for determining whether or not the paper sheet 41 has been transported out of the path, or whether or not its transportation has been completed.

If it is determined that the paper sheet 41 is not detected (NO in Step S20), the CPU 21 ends this processing. If it is determined that the paper sheet 41 is detected, or that the paper sheet 41 is still being transported (YES in Step S20), the CPU 21 returns to Step S13 and the subsequent Steps are repeated.

If it is determined to be an overlap phase difference (YES in Step S14), the value of the overlap frequency J is incremented by 1 (Step S15). If the incremented overlap frequency J is equal to or greater than a predefined threshold value K1 greater than 1 (YES in Step S16), the CPU 21 generates a signal indicating a "possibility of an overlap" and outputs this signal to the host PC 11 (Step S17). If the incremented overlap frequency J is less than the threshold value K1 (NO in Step S116) or if the process of Step S17 has been completed, the CPU 21 checks whether or not the incremented overlap frequency J is equal to or greater than a larger threshold value K2 (Step S18). If the incremented overlap frequency J is determined to be equal to or greater than this threshold value K2 (YES in Step S18), the CPU 21 generates a signal indicating an "overlap" and outputs it to the host PC 11 (Step S19). If the incremented overlap frequency J is determined to be less than K2 (NO in Step S18) or if the process of Step S19 has been completed, the CPU 21 checks whether or not the paper sheet 41 is detected (Step S20), as explained above.

In summary, the overlap detection unit 12 looks for an overlapped condition at a specified timing of sampling as long as the paper sheet 41 is being transported, or as long as the paper sheet 41 is being detected, to count the overlap frequency J and judges the possibility of occurrence of an overlap on the basis of the value of this overlap frequency J, the possibility of occurrence being outputted in two levels. If J is equal to or greater than the greater of two threshold values (K2), it is judged that there is certainly an overlap. If J is equal to or greater than the smaller of the two threshold values (K1) but smaller than the larger threshold value K2, it is judged that there is only a possibility of an overlap.

The invention does not impose any particular limitation on the manners in which Steps S16–S19 should be carried out. The CPU 21 may carry out actual operations $J \geqq K1$ or $J \geqq K2$ or compare the overlap frequency J with a preliminarily prepared table on threshold values stored in the memory device 22.

Although an example with two judgment levels has been shown above, neither is the number of levels intended to limit the scope of the invention. The number of the levels may be increased by introducing a corresponding number of threshold values.

Figure 6:
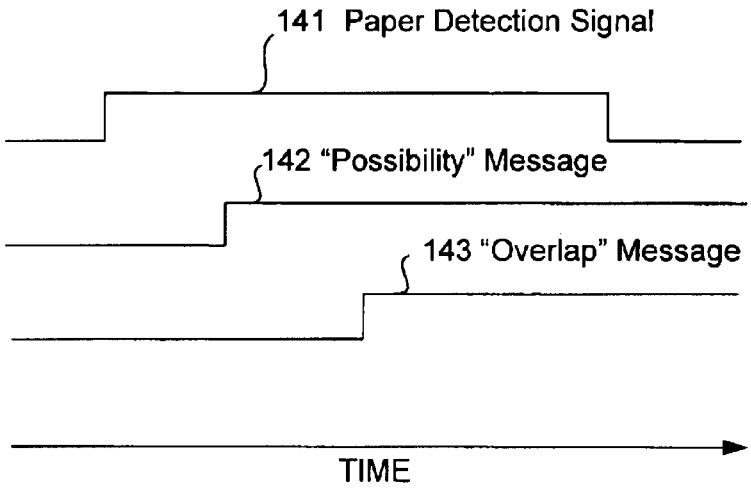
FIG. 6 is a timing chart for the transmission timing of paper detection signal, possibility message signal and overlap message signal.

FIG. 6 is a time chart for the transmission of signals corresponding to the judgments at these levels. When it is determined in Step S12 that the paper sheet 41 has been detected, the overlap detection unit 12 transmits to the host PC 11 a paper detection signal 141. If J is determined to be equal to or greater than K1 in Step S16, a "possibility message signal" 142 is outputted in Step S17. If it is determined that J is equal to or greater than K2 in Step S18, an "overlap message signal" 143 is outputted in Step S19.

Thus, when it is determined that there is a possibility of an overlap, the host PC 11 can continue the scanning operation of the scanner 3. As a result, the stopping of the transportation of the paper sheet 41 due to an erroneous detection of an overlap can be controlled and the user can be freed from the work of investigating the cause of the interruption in the transportation. Since a "possibility message signal" is transmitted to the user, furthermore, the user can postpone the investigation of the possibility until the scanning operation is completed.

An advantage of using two threshold values is that the level judgment can be carried out easily and that the user can easily vary the levels by changing the values of K1 and K2.

Figure 5:
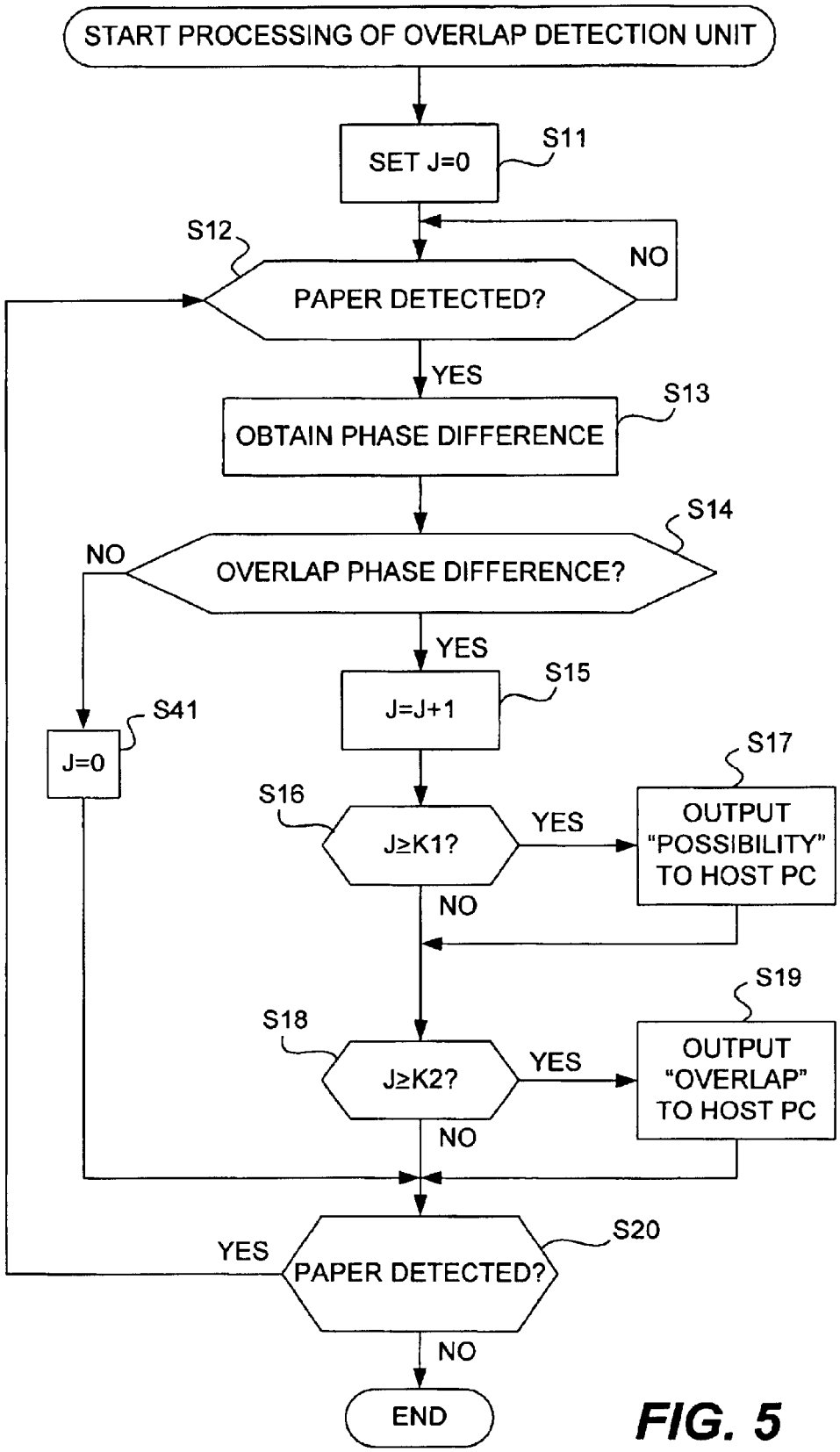
FIG. 5 is another flowchart for the processing by the overlap detection unit of the device of FIG. 1.

FIG. 5 shows another example of processing by the overlap detection unit 12 of FIG. 1. The flowchart of FIG. 5 is different from that in FIG. 4 only in that the overlap frequency J is reset to zero (Step S41) when it is determined in Step S14 that it is not a case of an overlap. This step is advantageous in that the possibility of an overlap can be more correctly judged and an erroneous detection of an overlap can be more reliably controlled.

Figure 7:
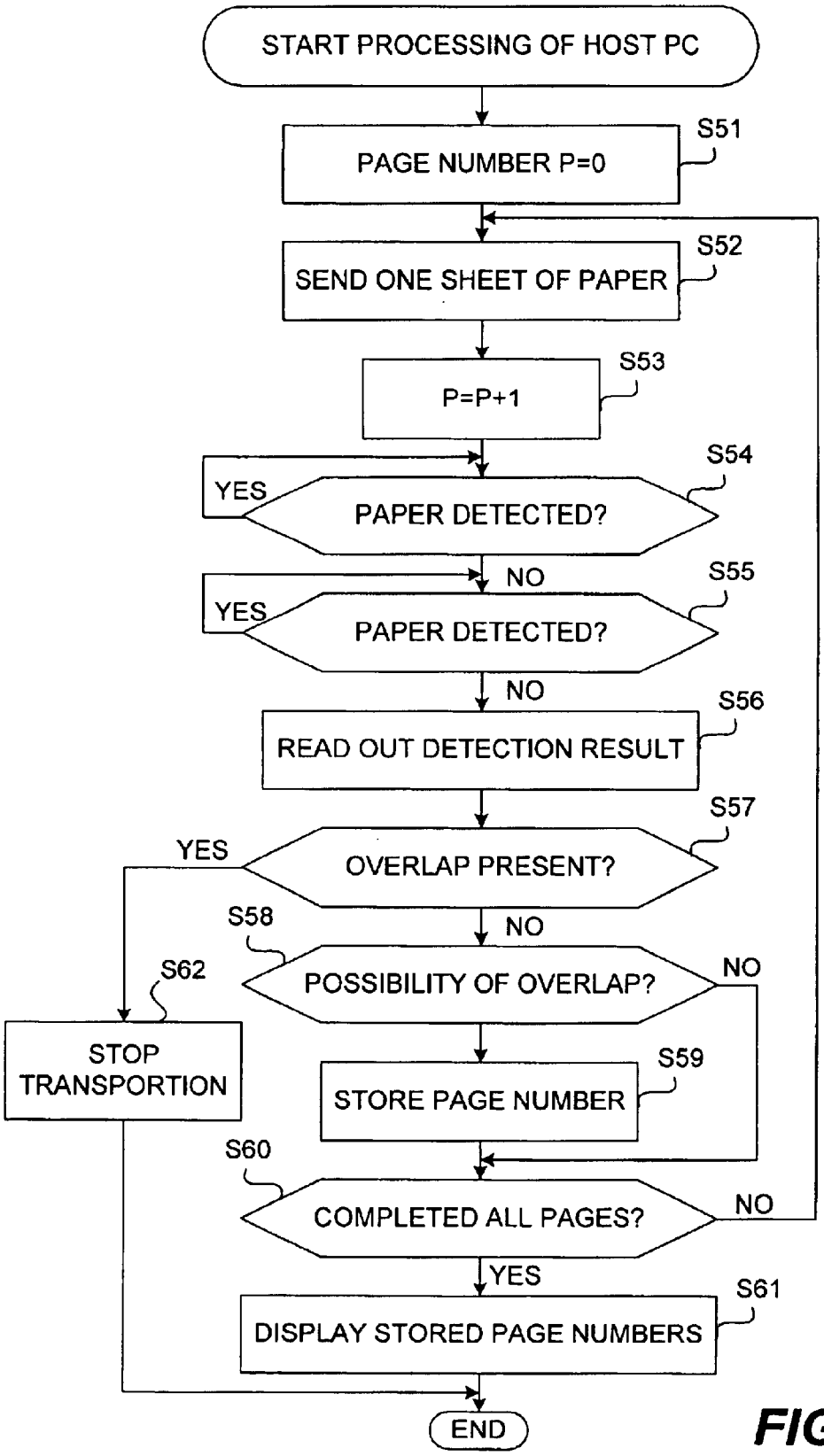
FIG. 7 is a flowchart for the processing by the host PC of the device of FIG. 1.

FIG. 7 is referenced next to explain an example of processing by the host PC 11 corresponding to the processing of the overlap detection unit 12 according to FIG. 4 or 5.

To start, the CPU 111 of the host PC 11 resets to zero the number P of paper sheets 41 sent onto the path of transportation (hereinafter referred to as the paper number, P being an integer). Explained more in detail, an area (referred to as the P-area) for storing the page number P is secured on the RAM 113 and numeral 0 is stored in the P-area as the initial value (Step S51). Next, the CPU 111 sends off one sheet of paper 41 onto its path of transportation (or places it on the paper feeding plate 32) by generating a paper transportation signal and supplying it to the overlap detection unit 12 through the bus 114 and the I/O interface 115 (Step S52). On the basis of this signal thus supplied, the CPU 21 of the overlap detection unit 12 controls its motor driver 24 through the processing unit 93 to rotate the motor 25 and to thereby transport the paper sheet 41.

Next, the paper number P is incremented by 1 and the incremented page number P =P+1 is stored in the P-area (Step S53). Next, the CPU 111 determines whether or not the overlap detection unit 12 has detected the paper sheet 41 by checking whether or not the aforementioned paper detection signal 141 has been transmitted from the overlap detection unit 12 (Step S54). If it is determined that the overlap detection unit 12 has not detected the paper sheet 41 (NO in Step S54), the CPU 111 waits until the detection is made. If it is determined that the overlap detection unit 12 has detected the paper sheet 41 (YES in Step S54), the CPU 111 further undertakes to determine whether or not the overlap detection unit 12 has detected the paper sheet 41 (Step S55). Explained more in detail, the detection in Step S54 is for judging whether or not the paper sheet 41 has been brought onto its path of transportation, or whether or not its transportation has started, while the detection in Step S55 is for judging whether or not the paper sheet 41 has been transported out from the its path of transportation, or whether or not its transportation has been completed.

If it is determined in Step S55 that the overlap detection unit 12 has detected the paper 41, or that the paper sheet 41 is being transported (YES in Step S55), the CPU 111 continues to wait. If a "possibility message signal" 142 is received from the overlap detection unit 12 in Step S17 of FIG. 4 or 5, however, the CPU 111 stores a data item to this effect in a specified area (referred to as the "overlap data memory address") on the RAM 113. If an "overlap message signal" 142 is received from the overlap detection unit 12 in Step S19 of FIG. 4 or 5, the CPU 111 similarly stores a data item to this effect at the overlap data memory address.

If it is determined in Step S55 that the paper sheet 41 is not being detected by the overlap detection unit 12, or that the transportation of the paper sheet 41 has not been completed (NO in Step S55), the CPU 111 reads out the data item stored at the overlap data memory address (Step S56). If the overlap data memory address is found to store a data item indicative of an overlap (YES in Step S57), the CPU 111 causes the transportation of the paper sheet 41 to be stopped (Step S62). This process of stopping the transportation of the paper sheet 41 is carried out in the same way as the prior art process of stopping the motion of a paper sheet when an overlapped condition is encountered. Explained more in detail, the CPU 111 generates a stop signal and supplies to the overlap detection unit 12 through the bus 114 and the I/O interface 115. Upon receiving this signal, the overlap detection unit 12 controls the motor driver 24 through the processing unit 93 to stop the rotary motion of the motor 25, thereby stopping the motion of the paper sheet 41.

If there is no data item indicative of an overlap (NO in Step S57), the CPU 111 further examines whether or not a data item indicative of a possibility of an overlap is stored (Step S58). If such a data item is found to be present (YES in Step S58), the CPU 111 causes the page number P stored in the P-area to be stored in another area (referred to as the display area) on the RAM 113 (Step S59). If it is determined that no data item indicative of a possibility of an overlap is present (NO in Step S58), or if Step 59 has been completed, the CPU 111 checks whether or not all of the paper sheets 41 have been transported (Step S60). If not all of the paper sheets 41 have been transported (NO in Step S60), the CPU 111 returns to Step S52 and repeats the subsequent Steps, causing the next one of the paper sheets 41 to be sent onto the path of transportation and checking whether or not this sheet is overlapped or there is such a possibility.

If it is determined that the transportation of all of the paper sheets 41 has been completed (YES in Step S60), the CPU 111 causes the page number P stored in Step S59, or data corresponding to the page number P with a possibility message signal to be displayed on the output device (CRT) 117.

The invention does not impose any particular limitation on the data to be thus displayed on the output device (CRT) 117 as long as the user can recognize the page number P corresponding to the possibility of an overlap.

Figure 8:
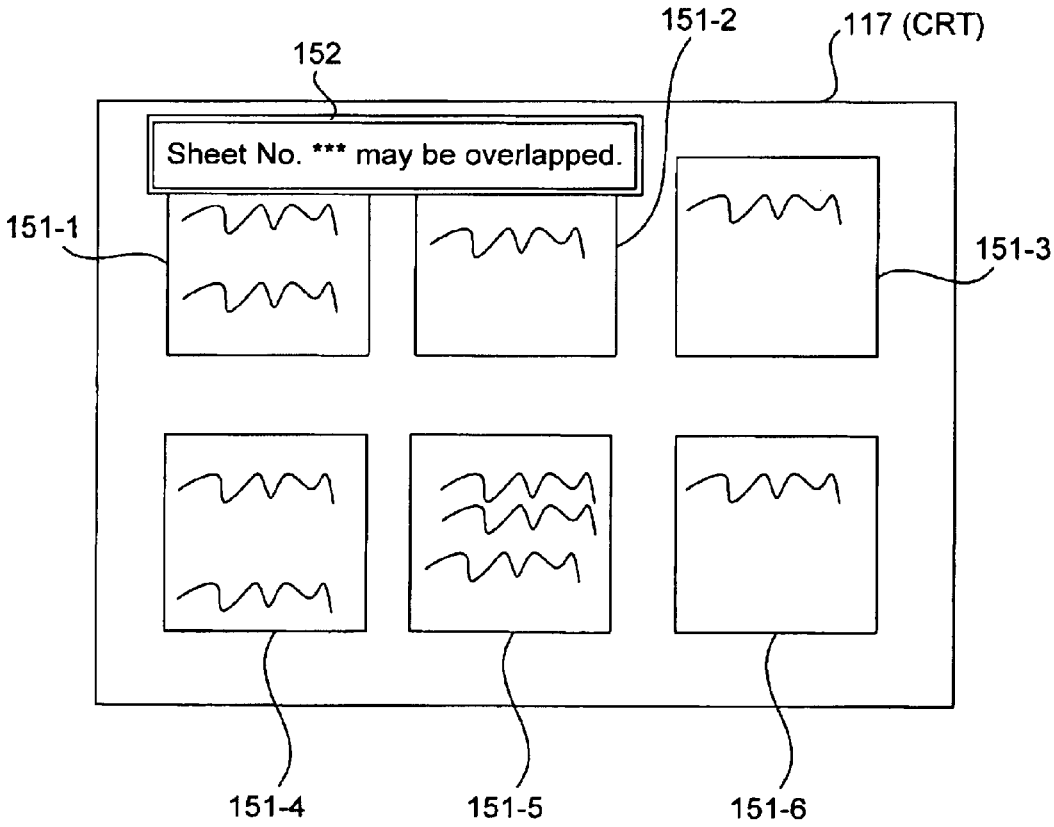
FIGS. 8, 9 and 10 are examples of display when it is judged that there is a possibility of an overlap.

Suppose now that six sheets of paper have been scanned. FIG. 8 is an example of display that may be made accordingly. Not only are images 151-1–151-6 displayed, there is also a message 152, indicating any possibility of an overlap, including the corresponding page number P with the possibility.

Figure 9:
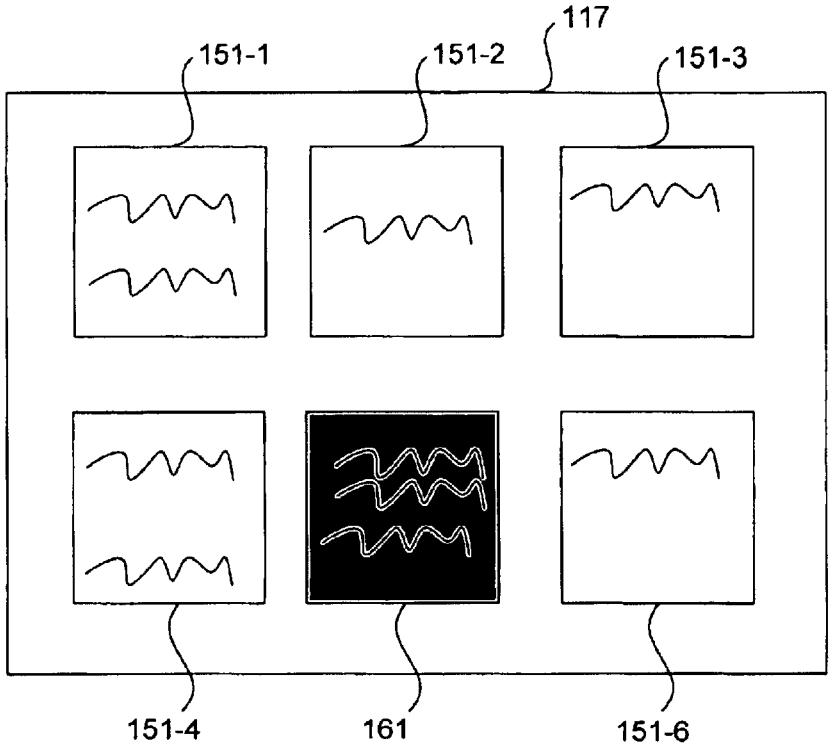
Figure 10:
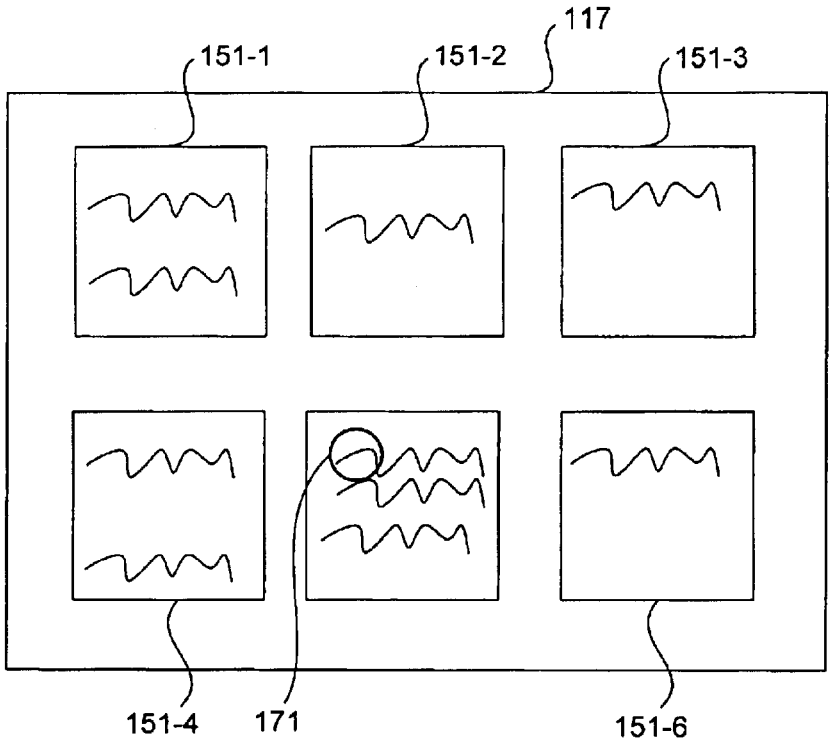

Alternatively, as shown in FIG. 9, the display may be made such that the page with the possibility of an overlap (indicated by Numeral 161) may be shown in a different color so as to be easily distinguished from normally scanned images 151-1–151-4 and 151-6. As a further alternative, as shown in FIG. 10, a special symbol such as a circle 171 may be displayed on the image with the stored page number P.

Figure 11:
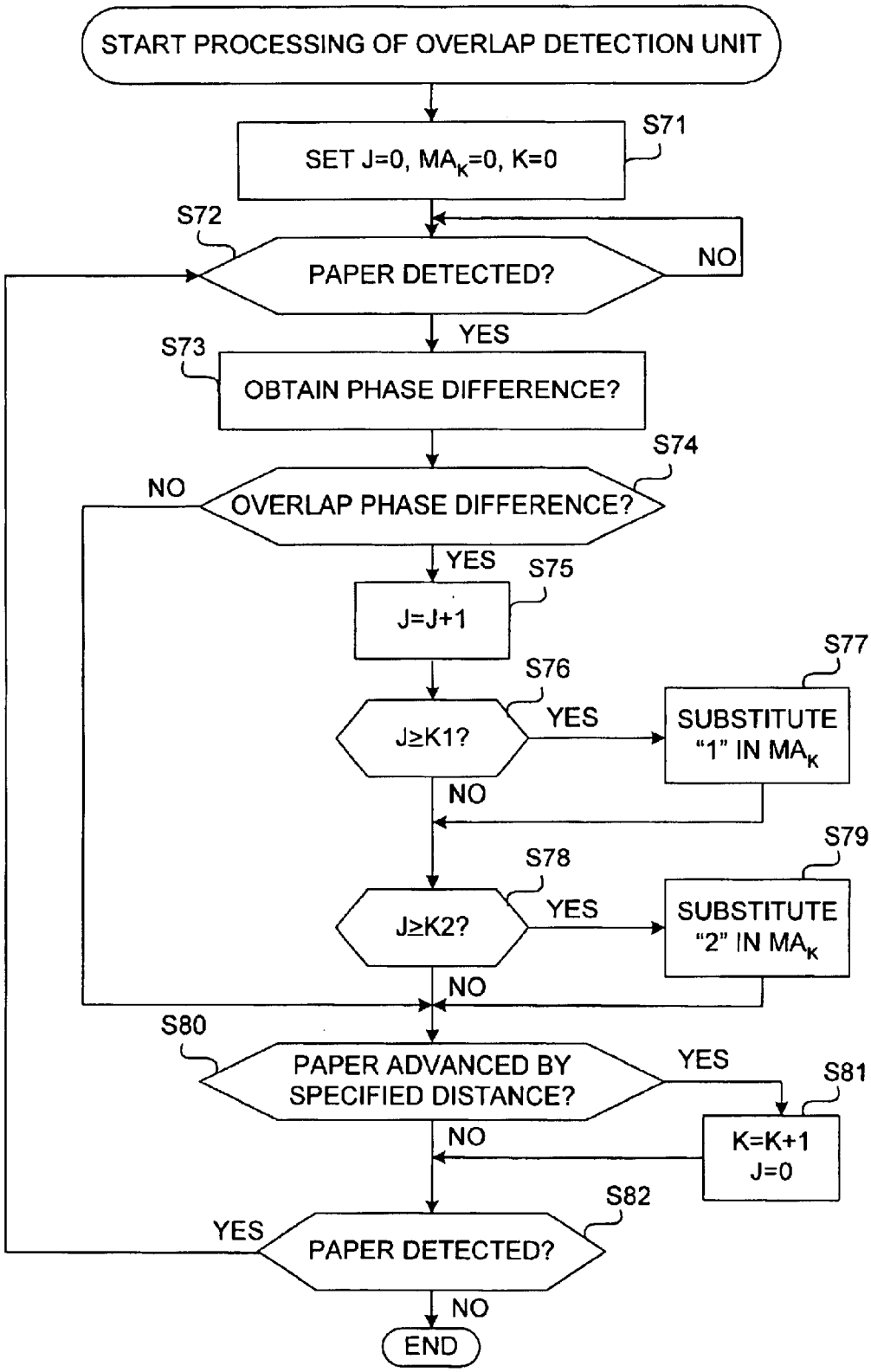
FIG. 11 is a flowchart for the processing by the overlap detection unit of FIG. 1 according to a second embodiment.

Next, the flowchart of FIG. 11 is referenced to explain the processing by the overlap detection unit 12 of FIG. 1 according to a second embodiment of the invention.

In an initialization step (Step S71), the CPU 21 resets the overlap frequency J of the judgment counter 97 to zero through the processing unit 93 and resets to zero the value inside the area (referred to as the "paper position area") on the memory device 22 for storing the paper position K. The CPU 21 also generates an initialization signal and supplies it to the host PC 11 to thereby set each value of the overlap data memory address on the RAM 113 of the host PC 11.

Next, the CPU 21 checks whether or not a paper sheet 41 has been detected (Step S72). If no paper sheet 41 has been detected (NO in Step S72), the CPU 21 continues to wait. If it is determined that a paper sheet 41 has been detected (YES in Step S72), a reception phase difference is obtained (Step S73) and the paper detection signal supplied from the level judging unit 75 through the processing unit 93 is outputted to the host PC 11. Next, the CPU 21 determines whether or not the obtained reception phase difference is an overlap phase difference (Step S73).

If it is determined that it is an overlap phase difference (YES in Step S73), the judgment counter 97 increments its overlap frequency J by 1, or J=J+1 (Step S75). The processing of Steps S72–S75 is the same as that of Steps S12–S15 of FIG. 4 and hence will not be described repetitiously.

If the incremented overlap frequency J is equal to or greater than a specified threshold value K1 (YES in Step S76), the CPU 21 generates a signal corresponding to a "possibility of an overlap" (Step S77) and outputs it to the host PC 11. Upon receiving this signal, the host PC 11 stores a value corresponding to the "possibility of an overlap" such as "1" at a corresponding address $MA_K$ within its overlap data memory address 183.

If the incremented overlap frequency J is determined to be less than K1 (NO in Step S76), or if the process of Step S77 is completed, the CPU 21 determines whether or not the overlap frequency J is greater or less than a larger threshold value K2 (Step S78). If the overlap frequency J is equal to or greater than K2 (YES in Step S78), the CPU 21 generates a signal indicative of an overlap and outputs it to the host PC 11 (Step S79). Upon receiving this signal, the host PC 11 stores another value corresponding to the "overlap" such as "2" at the corresponding address $MA_K$ within the overlap data memory address 183.

Figure 13:
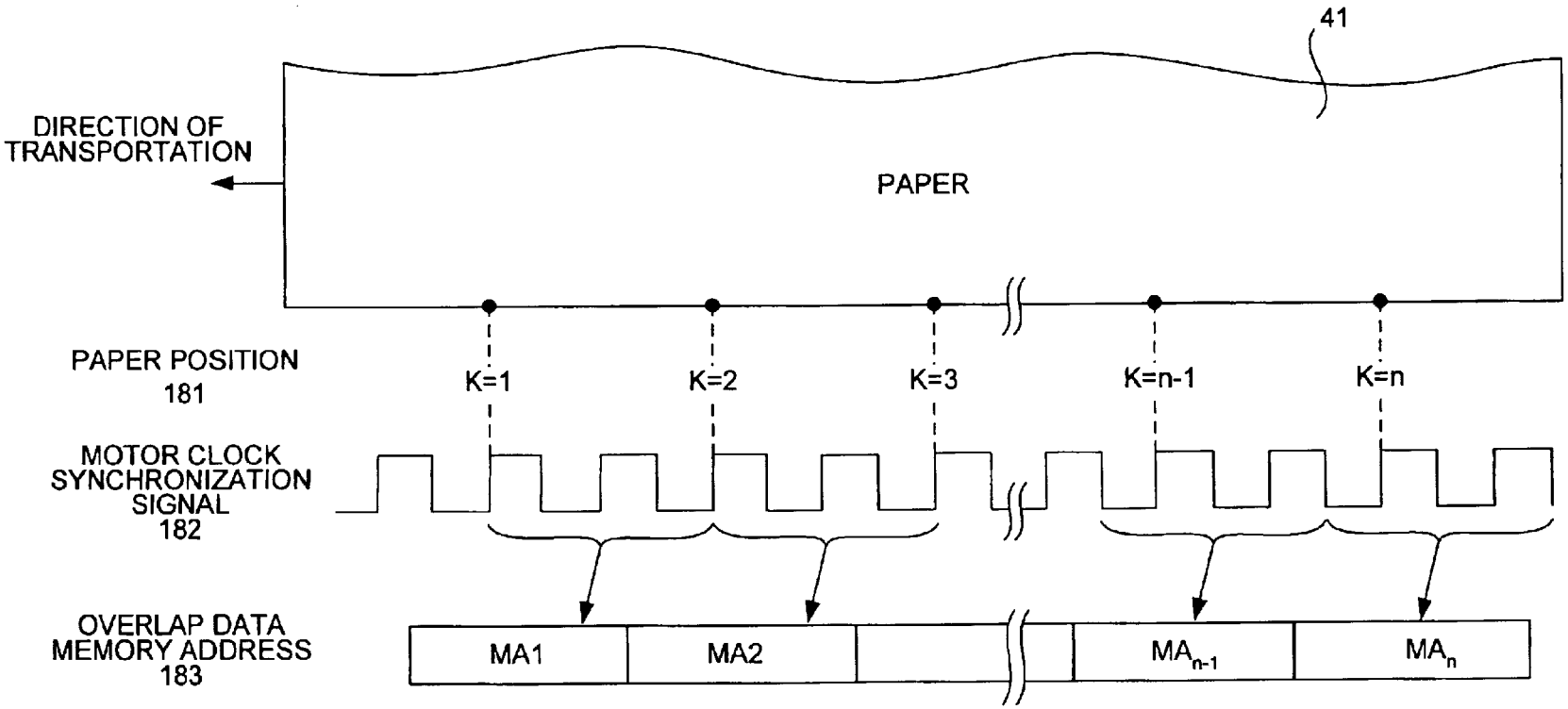
FIG. 13 is a diagram for showing the correspondence between the paper position and the overlap data memory address.

FIG. 13 shows schematically this relationship between the paper position and the overlap data memory address. With reference to FIG. 13, if the overlap detection unit 12 outputs a signal indicative of a possibility of an overlap at paper position K=1, the value "1" is stored at $MA_1$ of the overlap data memory address 183. If the overlap detection unit 12 outputs a signal indicative of an overlap at paper position K=2, the value "2" is stored at $MA_2$ of the overlap data memory address 183.

In this example, a signal corresponding to value "1" is outputted at paper position K=2 before a second signal corresponding to value "2" is outputted. Accordingly, value "1" is initially set at $MA_2$ of the overlap data memory address 183 and thereafter when the signal corresponding to "2" is outputted, the value "1" already set at $MA_2$ is deleted and replaced by "2". In other words, there is a correspondence between "K" of the paper position 181 and $MA_K$ of the overlap data memory address 183. These addresses $MA_K$ are initially reset (in Step S71) and contain 0. When it is determined that there is a possibility of an overlap at paper position K (or in the interval between positions K and K+1), value "1" is substituted at address $MA_K$. If it is determined that there is an overlap in this interval, value "2" is substituted at address $MA_K$.

If it is not an overlap phase difference (NO in Step S74), if J is less than K2 (NO in Step S78) or if the process of Step S79 has been completed, the CPU 21 determines whether or not the paper sheet 41 being scanned has advanced by a specified distance (Step S80). Explained more in detail, this is done by the CPU 21 calculating the distance of travel by the paper sheet 41 on the basis of the motor clock synchronization signals 182 supplied from the motor driver 24 through the processing unit 93, or the cumulative number of rotations of the motor 25. On the basis of this calculated distance, the CPU 21 determines whether or not the paper sheet 41 has advanced by a specified distance from the previous specified position K along its path of transportation or to the next specified position K+1.

Although FIG. 13 indicates a distance corresponding to two periods of the motor clock synchronization signal 182 as the specified distance, the length of this specified distance is not intended to limit the scope of the invention and may be arbitrarily set.

If it is determined that the paper sheet 41 has been advanced by the specified distance (YES in Step S80), the paper position value K is incremented by 1, or K=K+1 (Step S81). The incremented paper position value K is stored in the paper position area and a signal corresponding to this new paper position K is supplied to the host PC 11. On the basis of this supplied signal corresponding to the paper position K, the host PC 11 (or its CPU 111) determines the address $MA_K$ in the overlap data memory address 183 where value "1" or "2" should be substituted. In Step S81, the overlap frequency J of the judgment counter 97 is also reset to zero through the processing circuit 93 in order to check the possibility of an overlap in the next specified interval (from K+1 to K+2).

Next, if the CPU 21 determines that the paper sheet 41 is not being detected, or that its transportation has been completed (NO in Step S82), the process is concluded. If the paper sheet 41 is still being transported and hence it is detected (YES in Step S82), the CPU 21 returns to Step S73 and repeats the subsequent Steps.

Thus, if it is determined in Step S80 that the paper sheet 41 has not advanced by the specified distance and if it is further determined in Step S82 that the paper sheet 41 has been detected, or, for example, if a possibility of an overlap is always present at each sampling time in the interval between paper positions K and K+1, the corresponding value "1" for a possibility or "2" for an overlap is substituted at $MA_K$ in the overlap data memory address 183.

In other words, it is not the possibility-indicating value at one paper position K that is substituted at address $MA_K$ but the values corresponding to the interval between the paper positions K and K+1. As a result, as will be explained more in detail below, the host PC 11 can determine whether or not the entire surface of a paper sheet 41 is overlapped (from the front edge to the back edge) by referencing all of the addresses $MA_K$ in the overlap data memory address 183, and further determine therefrom whether or not an unwanted overlap has actually taken place.

Figure 12:
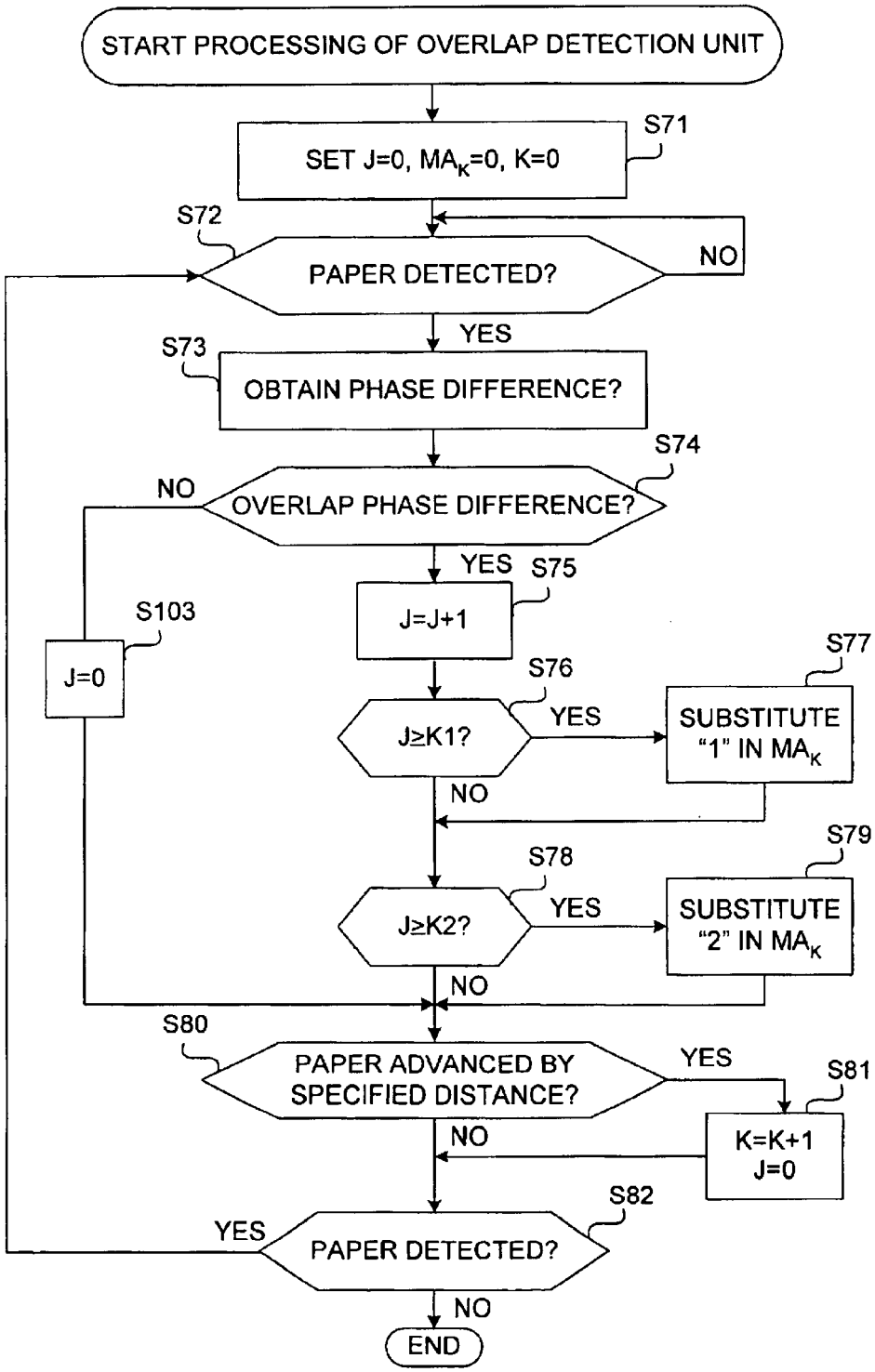
FIG. 12 is another flowchart for the processing by the overlap detection unit of FIG. 1 according to the second embodiment.

FIG. 12 is a flowchart for another process which is a variation of the process explained above with reference to FIG. 11. The flowchart of FIG. 12 is different from that of FIG. 11 only in that the overlap frequency J of the judging counter 97 is reset to zero through the processing unit 93 (Step S103) when it is determined in Step S74 that it is not an overlap. This program has the merit of more accurately judge the possibility of an overlap and an erroneous detection of an overlap can be prevented.

Figure 14:
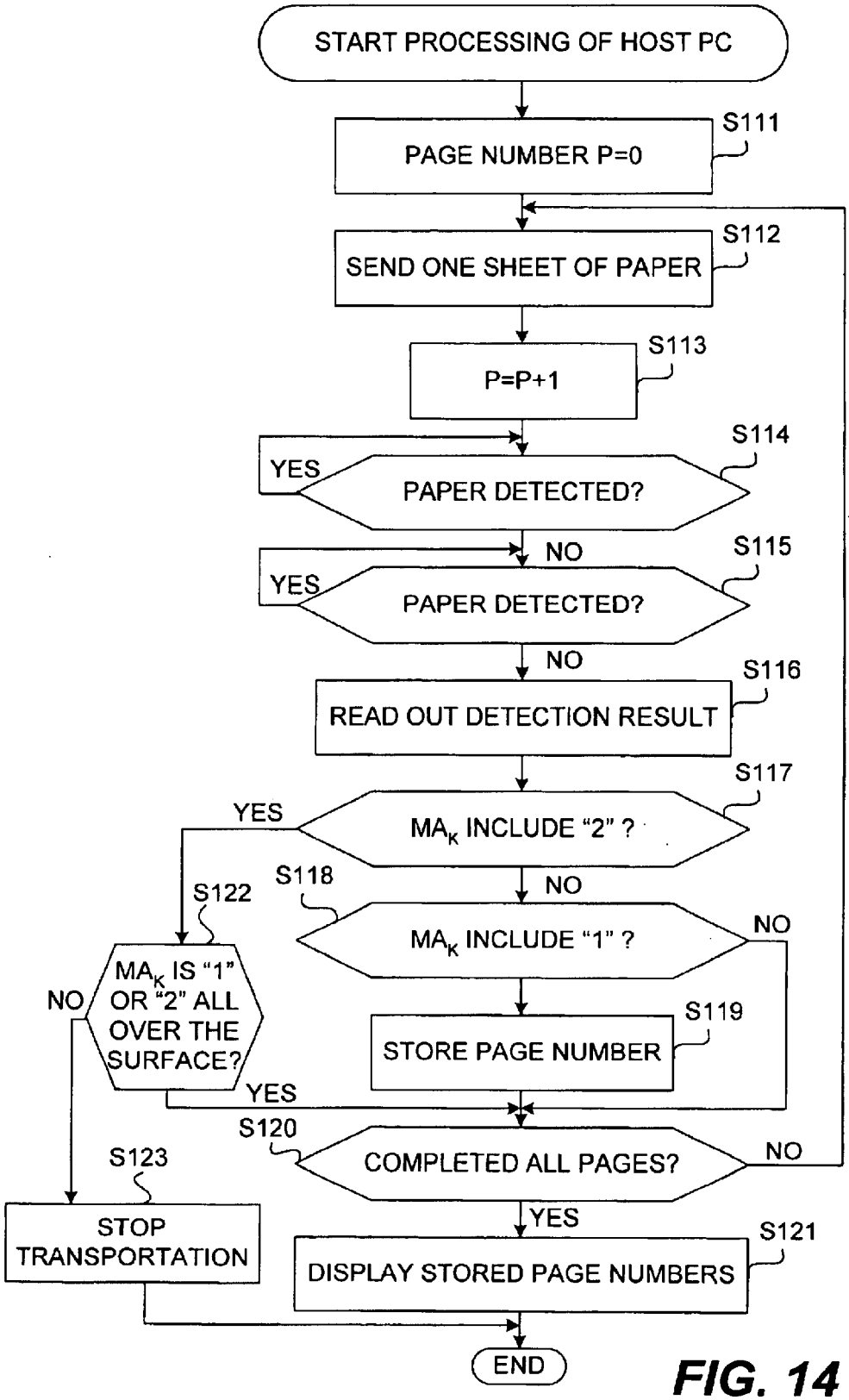
FIG. 14 is a flowchart for the processing by the host PC of the device of FIG. 1 according to the second embodiment.

FIG. 14 is referenced next to explain an example of processing by the host PC 11 corresponding to the operations of the overlap detection unit 12 shown by FIG. 11 or 12.

To start, the CPU 111 of the host PC 11 resets the page number P stored in the P-area (Step S111) and sends out one of the paper sheets 41 on the path of transportation (or places it on the paper feeding plate 32) (Step S112). Next, the CPU 111 increments the page number by 1, or P=P+1, and stores the incremented page number P in the P-area (Step S113).

Next, the CPU 111 determines whether or not the paper sheet 41 has been brought onto the path of transportation, or whether or not the transportation of the paper sheet 41 has been started (Step S114) and whether or not it has been transported out of the path, or whether or not its transportation has been completed (Step S115). Details of Steps S111–S115 are not repetitiously explained because Steps S111–S115 are the same as Steps S51–S55 of FIG. 7.

If a possibility-indicating signal corresponding to value "1" is received from the overlap detection unit 12 as a result of Step S77 in FIG. 11 or 12 before the transportation of the paper sheet 41 is completed (NO in Step S115), however, the CPU 111 substitutes its value at the corresponding address $MA_K$ in the overlap data memory address 183. Similarly, if an overlap signal corresponding to value "2" is received from the overlap detection unit 12 as a result of Step S79 in FIG. 11 or 12, the CPU 111 substitutes this value at the corresponding address $MA_K$ in the overlap data memory address 183.

If it is determined in Step S1115 that the overlap detection unit 12 is not detecting the paper sheet 41, or that the transportation of the paper sheet 41 has been completed (YES in Step S115), the CPU 111 reads out all of the values "1" and "2" as well as the initially set values "0" stored at the addresses $MA_K$ of the overlap data memory address 183 (Step S116).

Thereafter, the CPU 111 examines to determine whether value "2" is among the values read out in Step S116 (Step S117). If there is no "2" among the values read out (NO in Step S117), it is further checked to determine whether or not value "1" is among the values that have been read out (Step S118). If it is determined that there is "1" among the values that have been read out in Step S116 (YES in Step S118), the CPU 111 reads out the page number P stored in the P-area and stores it in the display area (Step S119).

If no "1" is found to be among the values read out in Step S116 (NO in Step S118), or if the process of Step S119 has been completed, the CPU 111 determines whether or not the transportation of all of the paper sheets 41 has been completed (Step S120). If it is determined that it has not been completed yet (NO in Step S120), the CPU 111 returns to Step S112 and repeats the subsequent Steps, sending off the next sheet of paper 41 on the path of transportation and checking whether or not there is a possibility of an overlap.

If it is determined that all of the paper sheets 41 have been transported (YES in Step S120), the CPU 111 causes data corresponding to the page numbers P determined to have a possibility of an overlap to be displayed on the output device (CRT) 117.

There is no special limitation on the data to be thus displayed on the output device (CRT) 117 as long as the user can recognize therefrom the page number P determined to have a possibility of an overlap. For example, a display may be made as shown in FIG. 8, 9 or 10.

If it is determined in Step S117 that value "2" is present (YES in Step S117), the CPU 111 examines whether or not $MA_K$ are "1" or "2" over the entire surface of the paper sheet 41 (Step S122). If "1" or "2" is substituted in all of $MA_K$, or if each $MA_K$ for the surface has "1" or "2" substituted therein (YES in Step S122), the CPU 111 concludes that there is no "overlap" and proceeds to Step S120, repeating the subsequent Steps.

If not every one of $MA_K$ is "1" or "2" on the surface and there is at least one $MA_K$ for the surface having "0" substituted therein (NO in Step S122), the CPU 111 concludes that there is an unintentional overlap and stops the transportation of the paper sheet 41 (Step S123) and concludes the operation.

In summary, if a possibility of an overlap is found all over the surface of the paper sheet 41, it is concluded that it is a doubly folded paper sheet or that two sheets of paper are intentionally overlapped and hence that it is not a situation where it should be concluded that there is an overlap in the ordinary sense. In other words, the overlap detector 1 according to this embodiment of the invention is capable of recognizing a doubly folded paper sheet and a pair of paper sheets intentionally overlapped one on top of the other.

Although the invention has been described by way of only a limited number of examples, these examples are not intended to limit the scope of the invention. For example, although the process shown by the flowcharts herein are intended to be carried out by software by the CPU 21 of the overlap detection unit 12 of FIG. 1 or the CPU 111 of the host PC 11, it is naturally possible to prepare a hardware device for carrying out such processes. Although the invention was described above by way of examples applicable to a scanner, neither is it intended to limit the scope of the invention. The invention is equally applicable to the detection of overlapped paper sheets in a copier, a printer or apparatus of other kinds adapted to transport sheets of paper one by one.

The steps of writing programs to be stored in the memory medium include not only processes to be carried out in the order of writing but also processes which need not be carried out in the time sequence but may be carried out in parallel or independently.

In summary, the device and method of the present invention can inform the user whether or not an overlap in a true sense of the word is present.

What is claimed is:

1. A device for detecting an overlap in a paper sheet being transported on a path, said device comprising:

an ultrasonic wave generator for generating ultrasonic waves to be made incident on said path;

an ultrasonic wave receiver for receiving said ultrasonic waves generated by said ultrasonic wave generator;

a phase difference detector for detecting a phase difference between the ultrasonic waves received by said ultrasonic wave receiver and a predetermined standard phase;

an overlap detector for detecting an overlap in a paper sheet being transported on said path from said phase difference detected by said phase difference detector;

a data generating device for generating a specified data item on said overlap detected by said overlap detector;

a level selector for selecting one of a plurality of preliminarily defined levels corresponding to said specified data item generated by said data generating device;

an output device for outputting said selected level by said level selector; and a judging device for judging that there is no possibility that an unintentional overlap has occurred if said overlap is detected by said overlap detector over an entire detection range of said paper sheet from a front edge to a back edge of said paper sheet.

2. The device of claim 1 wherein said data item indicates a possibility of occurrence of the overlap and said preliminarily defined levels include a first level indicating that said overlap is certainly taking place and a second level indicating that there is a possibility that said overlap is taking place.

3. The device of claim 2 wherein said data item includes a cumulative number of times said overlap has been detected by said overlap detector and said level selector includes a first level selector and a second level selector, said first level selector selecting said first level if said cumulative number is equal to or greater than a predefined first threshold value, said second level selector selecting said second level if said cumulative number is equal to or greater than a predefined second threshold value which is smaller than said first threshold value.

4. The device of claim 3 wherein said data generating device resets said cumulative number of times to zero if said paper sheet is on said path but said overlap has not been detected by said overlap detector.

5. A method of detecting an overlap in a paper sheet being transported on a path, said method comprising the steps of:

generating ultrasonic waves to be made incident on said path;

receiving said ultrasonic waves made incident on said path;

detecting a phase difference between the received ultrasonic waves and a predetermined standard phase;

detecting an overlap in a paper sheet being transported on said path from said detected phase difference;

generating a specified data item on the detected overlap;

selecting one of a plurality of preliminarily defined levels corresponding to said specified data item;

outputting said selected level; and judging that there is no possibility of an unintentional overlap if said overlap is detected over an entire detection range of said paper sheet from a front edge to a back edge of said paper sheet.

* * * * *